United States Patent [19]

Walther et al.

[11] 4,257,196

[45] Mar. 24, 1981

[54] METHOD OF AND APPARATUS FOR GRINDING WORKPIECES BY VIBRATORY SCOURING

[75] Inventors: Carl K. Walther; Hans Tolle, both of Wuppertal, Fed. Rep. of Germany

[73] Assignee: Carl Kurt Walther GmbH & Co., Wuppertal, Fed. Rep. of Germany

[21] Appl. No.: 30,123

[22] Filed: Apr. 16, 1979

[30] Foreign Application Priority Data

Apr. 20, 1978 [DE] Fed. Rep. of Germany ..... 2817312

[51] Int. Cl.[3] ..... B24B 31/00

[52] U.S. Cl. ..... 51/163.2; 51/316

[58] Field of Search ..... 51/163.1, 163.2, 313, 51/316

[56] References Cited

U.S. PATENT DOCUMENTS

| | | | |
|---|---|---|---|
| 3,161,997 | 12/1964 | Balz | 51/316 |
| 3,353,796 | 11/1967 | Roberts | 51/163.1 |
| 3,436,873 | 4/1969 | Biebel | 51/316 |
| 4,067,147 | 1/1978 | Lehaert | 51/163.2 |

*Primary Examiner*—Harold D. Whitehead

*Attorney, Agent, or Firm*—McDougall, Hersh & Scott

[57] ABSTRACT

Workpieces are ground by rolling them around with grinding bodies and microbodies (7) in a vibratory scouring container (1) while a processing liquid is fed into, and runs out again from, the scouring container. The microbodies run out of the container with the processing liquid, are washed and screened in a device (17) to separate those having dimensions less than a predetermined size. The residual larger microbodies are collected in a storage container (8'). The container (8') is subsequently mounted on a post (10) in place of a similar container (8) and the microbodies are returned in controlled amounts into the scouring container by flushing out through a discharge opening (11) with water.

6 Claims, 1 Drawing Figure

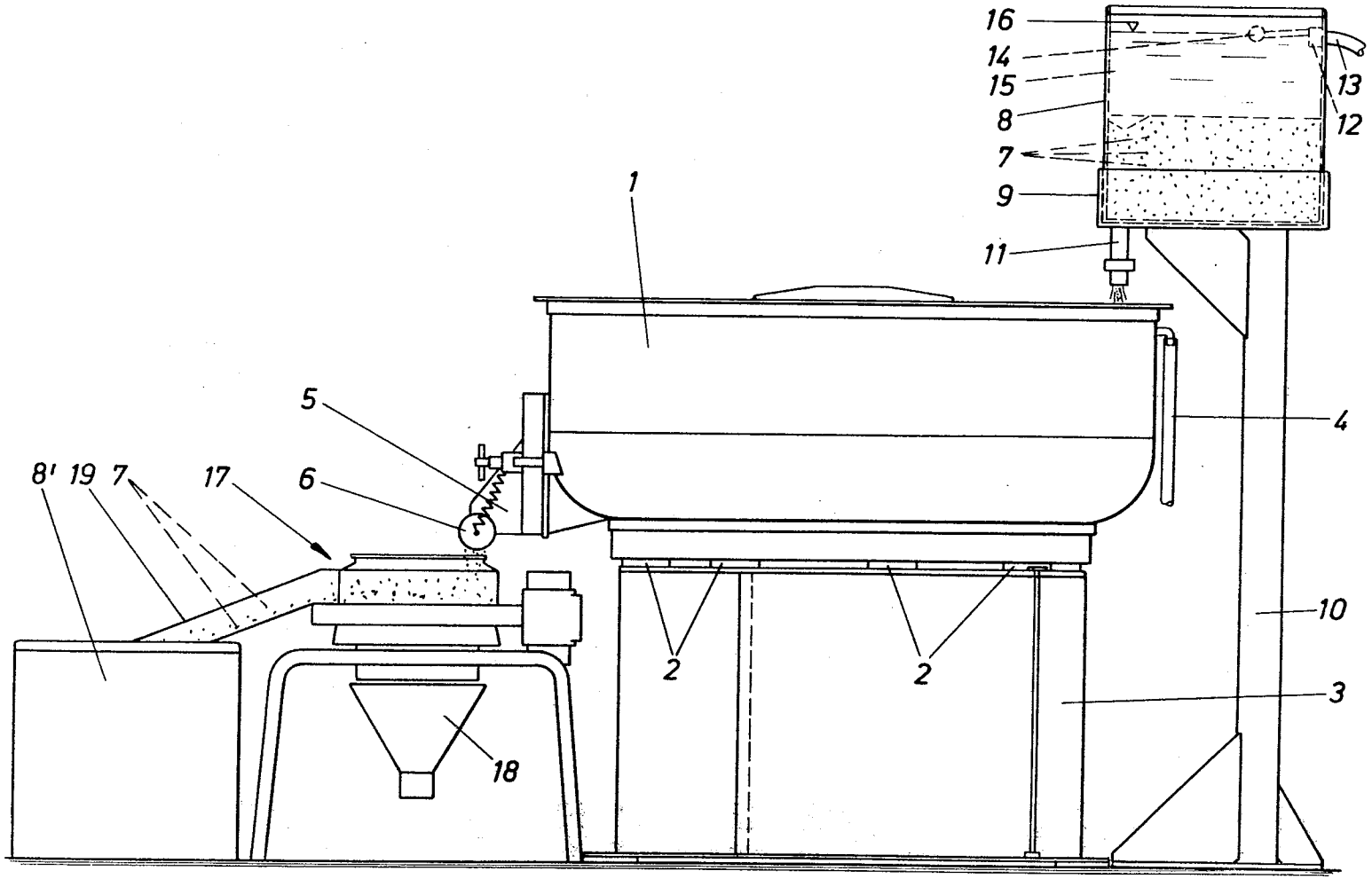
16
14
15
8
7
9
11
13
12
4
10
3
2
2
1
5
6
17
7
19
8'
18

METHOD OF AND APPARATUS FOR GRINDING WORKPIECES BY VIBRATORY SCOURING

The invention relates to the grinding of workpieces by vibratory scouring wherein the contents of a vibratory scouring container comprising the workpieces, grinding bodies and microbodies such, for example, as corundum or glass beads are rolled around, usually with a spiral motion, while a processing-liquid is fed into, and runs out again, usually through a screen, from, the scouring container.

In such a method the added processing-liquid serves in particular for inhibition of corrosion and for increasing the grinding and polishing effect. The microbodies rolling around with the container contents provide a better and more uniform grinding by, in the case of a material such as corundum, assisting directly in the grinding, but in any case by preventing individual workpieces, in particular those shaped with flat areas, sticking together in the form of packs during the rolling round. In this latter function they act as adhesion-inhibiting bodies. The microbodies consist of spherical, bead-like or cylindrical bodies which occur as a mixture of bodies with diameters and other dimensions between 0.3 and 2 mm, and which may be made of suitable plastics or glass (see West German Pat. No. 12,48,505). The mixture often includes microbodies which, because of their surface structure, are subject to surface abrasion. This reduces the efficiency of the microbodies when the method is carried out over long periods of time.

This problem is mitigated in accordance with the invention by improving the method such that the microbodies run out with the processing liquid, are washed and screened to separate those having dimensions less than a predetermined size, e.g. 0.3 mm, whereupon the residual larger microbodies are subsequently returned in controlled amounts into the scouring container.

Preferably, the microbodies returned to the scouring container are submerged in a liquid in a storage container and are added to the scouring container by flushing out with the liquid from the storage container.

The invention also includes an apparatus for carrying out the method, the apparatus comprising a vibratory scouring container and a storage container for the microbodies, the storage container having at the bottom a discharge opening leading, in use, to the scouring container, a liquid supply connection at its side, and a device for regulation of the level of liquid in the storage container.

Preferably, two similar interchangeable storage containers are provided and so constructed that one can be mounted on a support, which is provided adjacent to the scouring chamber, with its discharge opening overhanging the scouring container; while the other can be positioned to receive microbodies leaving a screening and washing device which is located to receive microbodies running out of the scouring chamber.

The invention leads to a number of advantages. Thus, at little expenditure the grinding performance prevailing initially through the usual optimum choice of the constituents of the contents of the scouring container is preserved in its entirety over the whole duration of the grinding process. The collecting, separating, washing and subsequent wet-proportioned restoration of the microbodies makes more uniform not only the grinding performance but confers too a better predeterminable control of the grinding process. Narrow internal holes drilled in the workpieces are always processed equally without danger of silting-up of the grinding bath.

A high-grade accurately proportioned feed of the microbodies is achieved, that is, in such a way that an addition of these bodies in the wet state is possible, so that microbodies which have possibly run out together with the processing-liquid and been collected again and washed are added directly after this recovery again in proportioned form into the grinding circuit. Use is made of the appreciation that the microbodies of appropriate material and size settle rapidly in a storage container in, for example, water, and that surprisingly the water above enforces a uniformly proportioned discharge by flushing out of the microbodies. At the same time it is furthermore surprising that the concentration, forming at the discharge, of these microbodies within the flushing out liquid remains nearly perfectly constant in spite of the height of the liquid above the sediment of microbodies. The concentration is largely exclusively dependent upon the size of cross-section of the discharge through which the liquid flushes out. Consequently new microbodies can, for example, be poured into the storage container also in batches. Variation of the liquid level in the storage container does not alter the concentration of the microbody/water dispersion flowing out into the vibratory scouring container. The volumetric proportion of the microbodies in relation to the water flowing is thus substantially always the same. The favourable distribution upon addition of the microbodies and also their uniform concentration optimizes the grinding process and is better than a batchwise addition of microbodies. There may be complete independence of the amount, concentration and consistency, of the processing-liquid, but if the occasion arises the microbodies may be fed back into the scrouding container with the processing-liquid.

The apparatus for carrying out the new method is distinguished moreover by a simle construction which is cheap to produce. It works furthermore without susceptibility to trouble. The device for regulation of the height of the surface of the liquid guarantees that the microbodies which sediment in the storage container are always inundated. The construction of the two storage containers as interchangeable alternate containers proves particularly economical. While from the one container mounted on a post or other support the microbodies are added with the liquid, collection of microbodies in the other container is effected. After the latter has been filled it is mounted on the support in place of the first container so that then the addition is effected out of the replacement storage container.

An example of an apparatus for carrying out the the method in accordance with the invention is illustrated diagrammatically in side elevation in the accompanying drawing.

A vibratory scouring container 1 made in the form of an annular channel is carried by spring components 2 which are supported on a machine frame 3. In the vibratory scouring container workpieces and grinding bodies (not shown) are rolled round in a spiral, i.e. substantially helical, path with the addition of a processing-liquid. The feed of the processing-liquid is effected via an inlet pipe 4 opening into the vibratory scouring container.

The vibratory scouring container is provided with a discharge connection 5 with which is associated a valve 6.

In order to improve the fineness of the grinding and/or to prevent the sticking together in packs of flat workpieces, microbodies 7 are added to, and roll around with, the contents of the vibratory scouring container. They form a mixture of bodies of sizes from about 0.3 to 2 mm and consist of materials such as glass, corundum, or suitable hard plastics as disclosed in West German Pat. No. 12,48,505.

The microbodies are fed from a storage container 8 which can be mounted in an open topped tray support 9, on a post 10, that is, in such a way that a discharge connection 11 at the bottom of the storage container 8 overhangs the vibratory scouring container 1. The storage container 8 further has at the top of its side a supply connection 12 for connection to a hose 13 for liquid. In the storage container 8 is a device for regulation of the height of the surface of the liquid. This consists of the ball float 14 which acts upon a valve associated with the supply connection. The liquid 15 running in through the supply connection 12 therefore inundates the sedimented microbodies 7, up the surface 16 of the liquid.

Because of the liquid inundating the microbodies and the discharge opening on the bottom a proportioned addition of the microbodies/liquid dispersion is effected.

The valve 6 of the connection 5 from the vibratory scouring container 1 is moreover set in such a way that the amount of the processing-liquid running out, enriched with microbodies, corresponds with the amount of the liquid fed in inclusive of the microbodies. The substance running out arrives in a screening and washing device 17 which, in this case, is a round screen vibrator. The liquid and sludge parts arrive in a collector hopper 18, whilst the cleaned microbodies 7 are led via a feed channel 19 into another storage container 8' serving as collector container.

When the collector container 8' is sufficiently full of microbodies it may as soon, as the storage container 8' is empty, take its place. The storage containers 8, 8' therefore fulfil the function of interchangeable alternate containers which permits economical working.

I claim:

1. A method of grinding workpieces by vibratory scouring of the workpieces in a vibratory container in the presence of grinding microbodies and a liquid comprising subjecting the workpieces, microbodies and liquid in the vibratory scouring container to vibratory action, removing microbodies together with liquid from the container during such vibratory movement, screening the removed microbodies and liquid to separate the undersized microbodies and liquid from the microbodies of predetermined size, and recycling the microbodies of predetermined size to the scouring container with liquid in amounts corresponding to that which is removed.

2. The method as claimed in claim 1 in which the microbodies are recycled by recycling the microbodies of predetermined size to a storage container overlying the vibratory scouring container, introducing liquid into the storage container to a desired level above the microbodies, and flushing liquid and microbodies in proportions from the storage container into the vibratory scouring container in amounts corresponding to the amount removed from the vibratory scouring container.

3. The method as claimed in claim 1 in which the microbodies are dimensioned within the range of 0.3–2 mm.

4. The method as claimed in claim 2 in which the storage container has an outlet overlying the vibratory scouring container to enable the microbodies and liquid to flow gradually from the storage container directly into the vibratory scouring container.

5. Apparatus for grinding workpieces by vibratory scouring in the presence of a liquid and microbodies for maintaining separation of the workpieces comprising a vibratory scouring container a storage container for microbodies and liquid an inlet in the storage container for the introduction of liquid a device for controlling the level of liquid in the storage container a discharge opening in the bottom portion of the storage container for flushing microbodies and liquid into the vibratory scouring container an outlet in the vibratory scouring container for removal of liquid and microbodies, and a washing and screening means for separating the liquid and undersized microbodies from the liquid and microbodies removed from the vibratory scouring container.

6. An apparatus as claimed in claim 5 which includes a second storage container, the first storage container being positioned with its discharge opening overlying the vibratory scouring container for enabling liquid and microbodies to flow gravitationally from the storage container into the vibratory scouring container, said secondary storage container being positioned adjacent the washing and screening means for receipt of microbodies which do not pass through the screening means.

* * * * *